US008141184B2

(12) United States Patent
Mondrush

(10) Patent No.: US 8,141,184 B2
(45) Date of Patent: Mar. 27, 2012

(54) PORTABLE PERSONAL HYGIENE APPARATUS

(76) Inventor: Ronald Mondrush, Milford, MI (US)

( * ) Notice: Subject to any disclaimer, the term of this patent is extended or adjusted under 35 U.S.C. 154(b) by 299 days.

(21) Appl. No.: 12/577,384

(22) Filed: Oct. 12, 2009

(65) Prior Publication Data

US 2010/0101015 A1 Apr. 29, 2010

Related U.S. Application Data

(60) Provisional application No. 61/197,178, filed on Oct. 24, 2008.

(51) Int. Cl.
*A47K 35/00* (2006.01)
*A61H 1/00* (2006.01)
*E03C 1/05* (2006.01)

(52) U.S. Cl. ..... 4/621

(58) Field of Classification Search ..... 4/619–622, 4/578.1, 465, 300, 661, 483; 297/68; D24/203–204; 607/81

See application file for complete search history.

(56) References Cited

U.S. PATENT DOCUMENTS 3,879,085 A * 4/1975 Morel ..... 297/182
4,237,561 A * 12/1980 Britton ..... 4/546
4,337,540 A * 7/1982 Lindeman ..... 4/546
4,340,981 A * 7/1982 Vanags ..... 4/536
4,809,368 A * 3/1989 Johansson ..... 4/540
4,998,302 A * 3/1991 Silva ..... 4/516
5,329,651 A * 7/1994 Mardero et al. ..... 4/605
5,393,119 A * 2/1995 Mukai ..... 297/217.1
5,459,887 A * 10/1995 Roman et al. ..... 4/541.4
5,489,140 A * 2/1996 Van Horn-Plato ..... 297/310
5,647,071 A * 7/1997 Suzuki et al. ..... 4/555
5,842,238 A * 12/1998 Herrick et al. ..... 4/516
5,978,983 A * 11/1999 Queen et al. ..... 4/556
6,390,550 B1 * 5/2002 Paredes et al. ..... 297/250.1
6,415,460 B1 * 7/2002 Rossman et al. ..... 4/572.1
6,503,212 B2 * 1/2003 Park ..... 601/158
6,516,477 B1 * 2/2003 Storm ..... 4/604
6,766,543 B1 * 7/2004 Hollis et al. ..... 4/555
7,107,630 B2 * 9/2006 Noro et al. ..... 4/556
7,140,054 B2 * 11/2006 Charles ..... 5/606
2010/0101015 A1 * 4/2010 Mondrush ..... 4/621

* cited by examiner

*Primary Examiner* — Lori Baker
(74) *Attorney, Agent, or Firm* — Carrier Blackman & Associates, P.C.; Joseph P. Carrier; William D. Blackman

(57) ABSTRACT

A portable personal hygiene apparatus, includes a water-impermeable user support shaped to support a person in a reclined posture, including a support surface contoured to receive a person's body thereon and a raised side surface extending continuously from the support surface completely around upper and lateral side edges of the support surface such that water discharged onto a person seated on the support surface is contained by the user support and flows downwardly to a front lower edge of the support surface, and a support frame fixed to the user support and having at least one wheel permitting rolling movement of the apparatus. The raised side surface of the user support is narrow in width such that an overall width of the user support substantially corresponds to a width of the support surface. Also, a basin may be provided that is selectively positionable in a retracted position beneath the user support and an operative position extending forwardly of the lower front edge of the support surface such that any water flowing off of the support surface collects in the basin.

16 Claims, 10 Drawing Sheets

PORTABLE PERSONAL HYGIENE APPARATUS

BACKGROUND OF THE INVENTION

1. Field of the Invention

The invention relates to a portable personal hygiene apparatus for use by persons with limited physical mobility, including elderly and physically handicapped individuals. More particularly, the invention relates to such an apparatus that can be readily transported to almost any location, e.g., adjacent to a patient's bed, half bath, kitchen, laundry room, etc., and includes a contoured, water-impermeable user support that will comfortably accommodate most persons in a sitting posture, and conveniently permits personal hygiene tasks such as bathing/showering, hair shampooing, manicure or pedicure, etc. to be performed by a caregiver while a person is seated in the contoured user support. The apparatus of the invention avoids the conventional need of transporting an elderly, invalid or disabled patient to the shower or bathtub where hazards may cause injuries to the caregiver and the patient, while still providing a high-quality, refreshing, bathing experience for the patient.

2. Description of Related Art

When a person suffers an injury, aging, illness or disability that prevents the person from normal physical activities, additional care is needed for the person, or invalid. This additional care may involve providing aid for enabling use of a shower or bath by the person. Bathing, however, is quite important not only for the person's health, but for the person/patient to maintain high self-esteem and dignity.

A common solution is to position a chair within a conventional shower stall or bathtub for the limited mobility person to sit upon. Unfortunately, the use of a chair in such setting requires the transfer of the person to the chair which his disposed in the tub or in the shower stall. It is not uncommon for injuries to occur to the caregiver and/or the limited mobility person being transferred to the bathing area.

Another common solution is the sponge bath. The sponge bath is often performed by a caregiver or nurses aide, and does not provide a refreshing experience analogous to a conventional bath or shower.

Another known solution for bathing an invalid is to transfer the individual to a wheelchair for transportation to a wheelchair accessible shower stall.

All of these known solutions have the disadvantage of requiring transport of the limited mobility person to the shower or bath, requiring staff and equipment for the transfer. Injuries to the caregivers and the patients can occur during these transfers since water and other hazards abound. In addition, the level of awareness of the patient and weight of the invalid patient can cause difficulties in the transfer of the patient to and in the bathing facilities.

In view of the known disadvantages, there have been proposed some mobile bathing apparatus which can significantly reduce the amount of movement required for transferring and retaining the limited mobility person to a location where the person may be bathed. Such known mobile showering apparatus are, for example, disclosed in U.S. Pat. No. 6,516,477, issued in 2003 to Storm, entitled "SHOWER APPARATUS FOR SEATED OCCUPANT, U.S. Pat. No. 5,978,983, issued in 1999 to Queen et al., entitled PORTABLE SHOWERING CABINET, and U.S. Pat. No. 4,974,268, issued in 1990 to Cors et al., entitled CHAIR BATHUB. Each of these known apparatus includes a showering nozzle connected/connectable to a water supply for discharging clean water onto a patient seated or supported in the apparatus, collects water that has been used to bathe the patient, and possibly discharges the collected bath water to a sewer drain or the like.

While these known apparatus provide bathing options for persons with limited physical mobility, they still have certain limitations and disadvantages associated therewith. For example, the apparatus of U.S. Pat. No. 5,978,983 is relatively complex and involved leading to a prohibitive cost. Also, while it is mobile, it still relatively large so that it cannot be easily transported to some confined locations, such as within a bedroom, in a half bath, or next to a patient's bed. Still further, this apparatus includes an enclosed chair that may be difficult for an invalid to access and/or to remain comfortably seated in during a bathing operation. The apparatus of U.S. Pat. No. 6,516,477 must be used in conjunction with a toilet, and the apparatus of U.S. Pat. No. 4,974,268 has limited mobility/transportability that makes it inappropriate for many situations.

The present invention has been developed to address the disadvantages of known bathing apparatus for individuals with limited physical mobility, and to fulfill a perceived need in the art for a bathing apparatus which can comfortably accommodate most persons, provide a high-quality, refreshing, bathing experience for the persons, is substantially-fully contained, can be readily transported to substantially any location, and yet is simple and economical to manufacture.

BRIEF SUMMARY OF THE INVENTION

It is an object of the invention to provide a portable bathing chair that can be moved to the limited mobility person in substantially any location. This minimizes the possibility of injury to the person and the person's caregiver while moving the person to/from the chair, while allowing the person to retain privacy and dignity while he/she bathes their self or is bathed/showered by the caregiver.

It is a second object of the invention to provide a highly portable apparatus that is easily moved to the patient. The apparatus has a streamlined, narrow, lightweight structure and is capable of being easily moved by a single person and fits through substantially all doors.

It is a further object of the invention to provide a comfortable, self-contained personal hygiene apparatus in the form of a portable bathing chair that provides the user/patient's caregiver with all the requirements to easily perform personal hygiene tasks, a high-quality, refreshing, bathing experience, and yet is relatively uncomplicated and economical to manufacture.

It is yet another object of the invention to provide a personal hygiene apparatus that allows easy access to the chair for the limited mobility person, as well as a comfortable, contoured support surface for supporting the patient in a substantially upright seating posture. The bathing chair in accordance with the invention allows access to the apparatus by moving the apparatus in close proximity to the limited mobility person or to a water supply according to conditions. In addition, the chair allows a wheelchair bound individual to move to the apparatus and transfer to the apparatus from the wheelchair with minimal movement of the patient.

According to a first aspect of the invention there is provided a portable personal hygiene apparatus, comprising: a water-impermeable user support shaped to support a person in a sitting posture, including a support surface contoured to receive a person's body thereon and a raised side surface extending continuously from the support surface completely around upper and lateral side edges of the support surface such that water discharged onto a person seated on the support surface is contained by the user support and flows downwardly to a front lower edge of the support surface; a support frame fixed to the user support and having at least one wheel permitting rolling movement of the apparatus; a tub movably connected to the user support and selectively positionable in a retracted position beneath the user support and an operative position extending forwardly of the lower front edge of the support surface such that water flowing off of the support surface collects in the tub. Preferably, the raised side surface of the user support is curved, and is narrow in width such that an overall width of the user support substantially corresponds to a width of the support surface.

Texturing may also be selectively formed on a couple limited parts of the user support and/or the tub to enhance the ability of a patient to better grip parts of the user support and/or the tub, e.g., horizontal upper surfaces on opposite sides of the seat which the user may grip with his/her hands when getting onto and off of the user support, and surfaces on the bottom of the tub on which the user may rest his/her feet. However, for ease of cleaning and maintaining the user support in clean condition, it is best that the exposed surfaces of the user support are formed smooth and remain smooth. Texturing creates areas for dirt and grime to accumulate.

Additionally, the apparatus may include hosing which may be selectively connected to a water supply and used to discharge water onto a person seated on the user support, and which may also be used for discharging used water from the tub, as well as a pump for facilitating discharge of the used water.

The user support may include a main portion which receives a person's torso and lower body, and an upper portion which is adjustably/slidably connected to the main portion in a watertight manner, wherein each of the main and upper portions include parts of the support surface and the raised side surface.

The invention comprises a portable personal hygiene apparatus in the form of a bathing chair that is easily transported to limited mobility persons desiring to use the same. The apparatus is self-contained in that all the needed elements for personal hygiene are provided, exclusive of a water supply, although the apparatus preferably includes extendable/retractable hosing which permits the apparatus to be readily connected to a regulated water supply (faucet) within a reasonable distance of the apparatus. The apparatus is contoured to conveniently drain and collect water discharged onto a person seated on the apparatus to a lower end of the apparatus and may include a mechanism, e.g., a pump and extensible hosing, for discharging collected water to a suitable drain or the like.

The apparatus may include a tub or foot basin that is movable between a stored position beneath the apparatus and an operative position extending forwardly of the apparatus where it collects water that has drained from the apparatus. The movable nature of the tub facilitates the ease with which limited mobility persons can get on/off the apparatus because such persons can stand directly in front of the apparatus when the tub is moved to its retracted position. After the person is seated, the foot basin is moved to its operative position to collect the used bath water and allow this water to be discharged to the remote drain. An upper portion of the apparatus may adjust upwardly/downwardly to accommodate different sized persons, and may extend somewhat rearwardly to better capture water when a user's hair is being washed.

Intent of Disclosure

Although the following disclosure offered for public dissemination is detailed to ensure adequacy and aid in understanding of the invention, this is not intended to prejudice that purpose of a patent which is to cover each new inventive concept therein no matter how it may later be disguised by variations in form or additions of further improvements. The claims at the end hereof are the chief aid toward this purpose, as it is these that meet the requirement of pointing out the improvements, combinations and methods in which the inventive concepts are found.

There have been chosen specific embodiments of a cover system according to the invention and specific alternative structures and modifications thereto, the embodiments chosen for the purposes of illustration and description of the structure and method of the invention are shown in the accompanying drawings forming a part of the specification.

BRIEF DESCRIPTION OF THE DRAWINGS

FIG. 2 illustrates a side view of the apparatus of FIG. 1, while

DETAILED DESCRIPTION OF THE INVENTION

Figure 1:
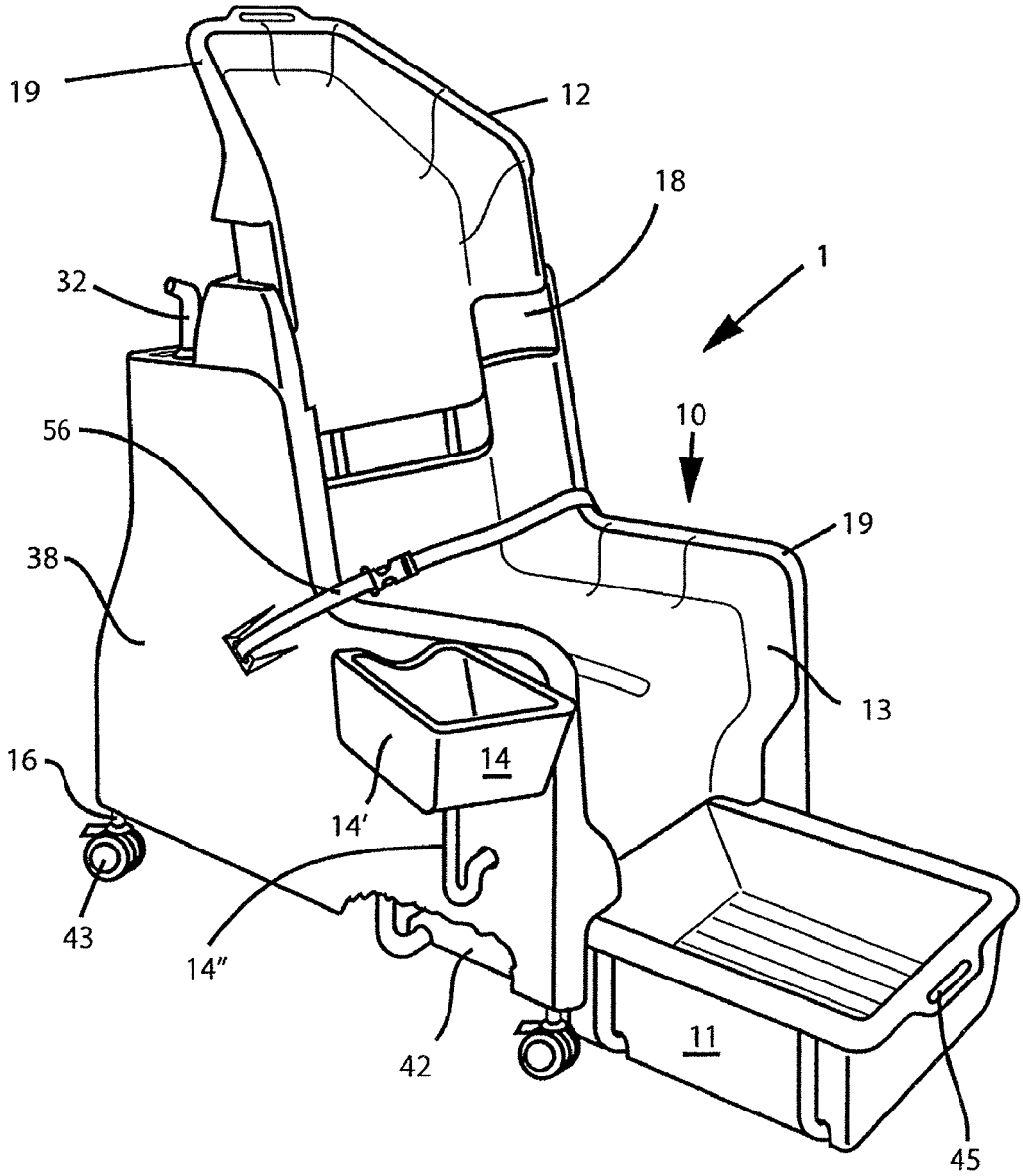
FIG. 1 illustrates a perspective view of a present embodiment of a personal hygiene apparatus in accordance with the invention, and with a foot basin or tub thereof disposed in an operative extended position thereof.
Figure 2:
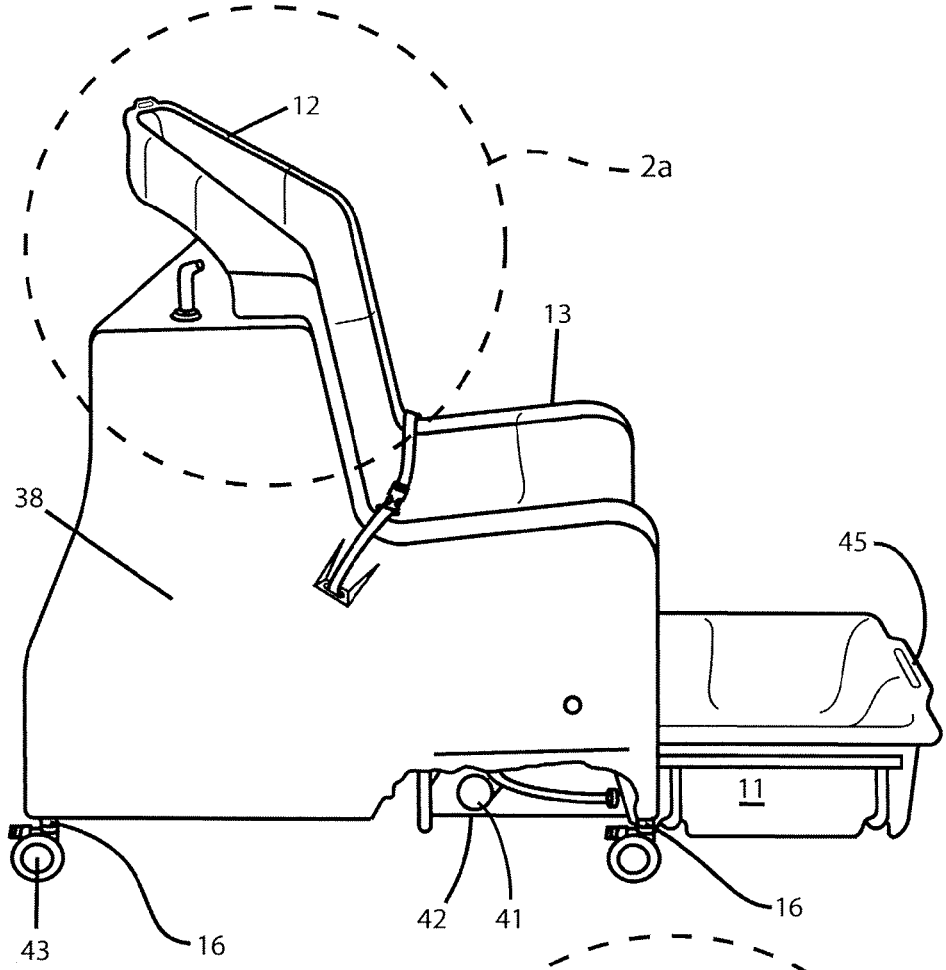
Figure 2A:
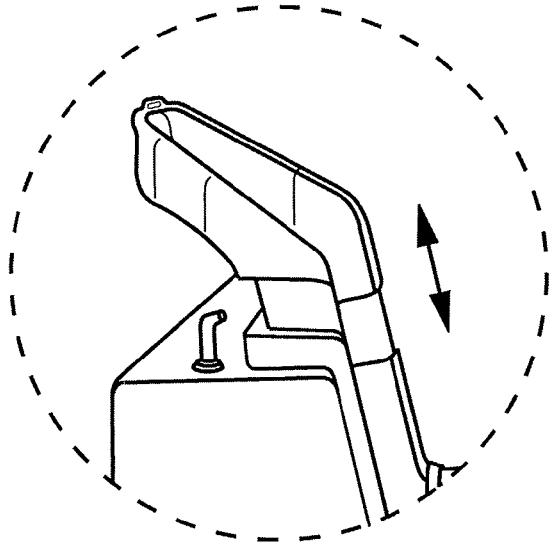
FIG. 2A is a slightly enlarged view of the portion circled in FIG. 2, and which indicates the adjustable up and down movement thereof.
Figure 3:
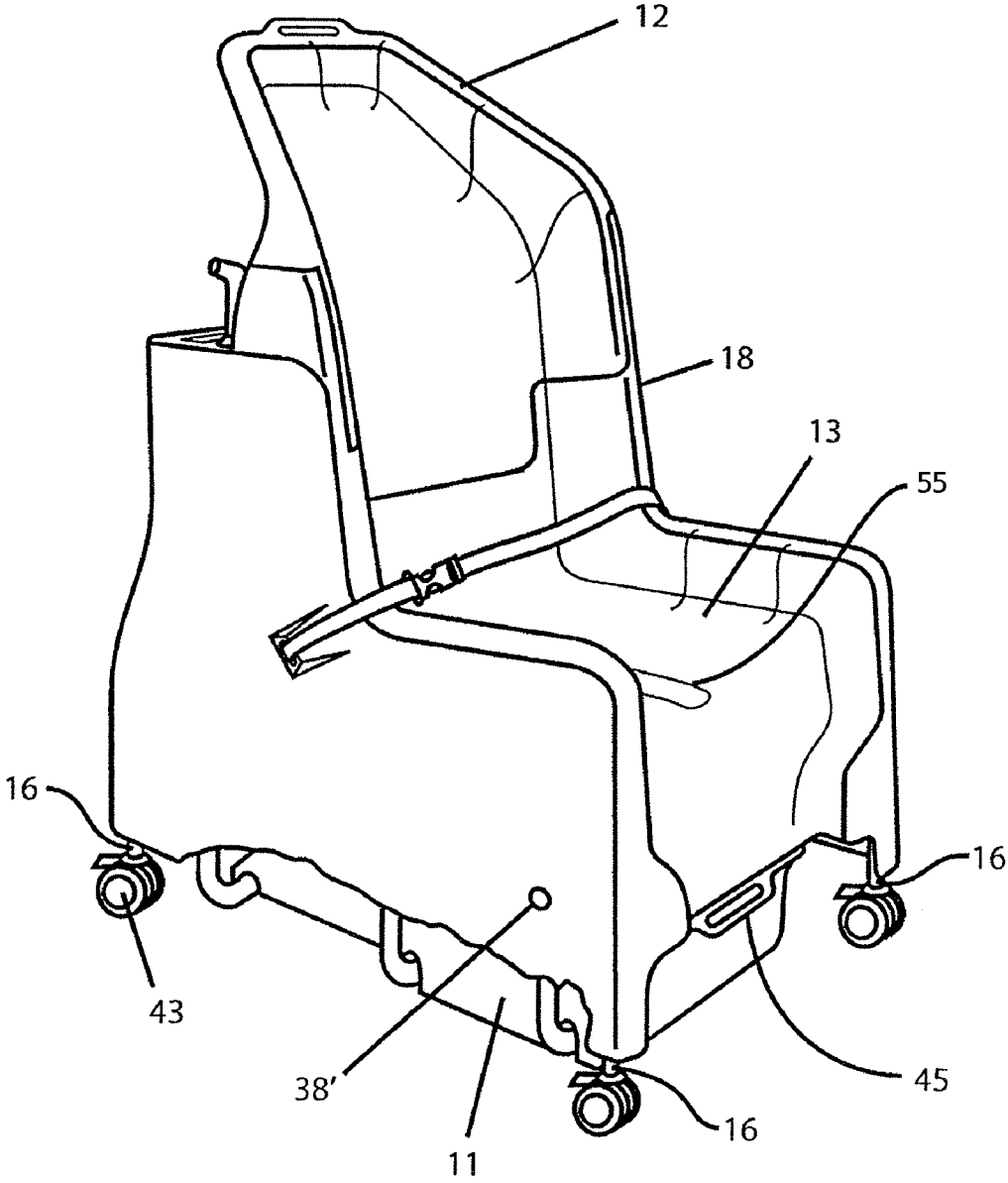
FIG. 3 illustrates a perspective view of the apparatus of FIG. 1 with the foot basin in a retracted position thereof position.

Present embodiments of the invention will now be described with reference to the accompanying drawings, wherein like reference characters designate like or similar parts throughout.

FIGS. 1-8B illustrate a portable personal hygiene apparatus according to an embodiment of the present invention. The apparatus 1 generally comprises: a watertight user support portion 10 shaped to comfortably support most persons in a substantially upright seated posture and formed of plastic or other appropriate material; a frame 20 formed of aluminum tubing or other appropriate material that is fixed to the user support and together therewith provides strength and rigidity for the apparatus, and includes wheels 43 to facilitate movement of the apparatus to any desired location; a retractable foot basin or tub 11 which moves between a storage position beneath the user support 10 and an operative position extending forwardly of the user support 10 where it can collect water draining from the user support and can comfortably accommodate the feet of a person sitting on the user support; a housing 38 which encloses the lateral and rear sides of the user support 10; extensible hosing 34 stored within the housing 38 behind the user support 10, which may be extended and attached to an appropriate water supply such as a sink faucet; an extensible water discharge nozzle 32 through which water may be conveniently discharged onto a person seated on the user support 10; an extensible water discharge hose 35 also stored within the housing 38 behind the user support 10 which may be extended and secured to an appropriate drain such as a sink or toilet, for example, for discharging used bath water collected in the foot basin 11; a pump 41 secured beneath the user support 10 which may be activated by switch 33 for discharging used water through the hose 35; a power supply 30 such as a rechargeable battery; a drip tray console 26 which may include dispensers 36 for soap, shampoo, lotion, etc.; a storage receptacle 27 disposed beneath the drip tray console 26 within the housing 38 which can store the extensible hosing 34, 35; and a removable hand basin 14 which may be stored beneath the user support 10 or operatively connected at either side of the housing 38 where a person seated on the user support 10 may conveniently place their hand.

Figure 5:
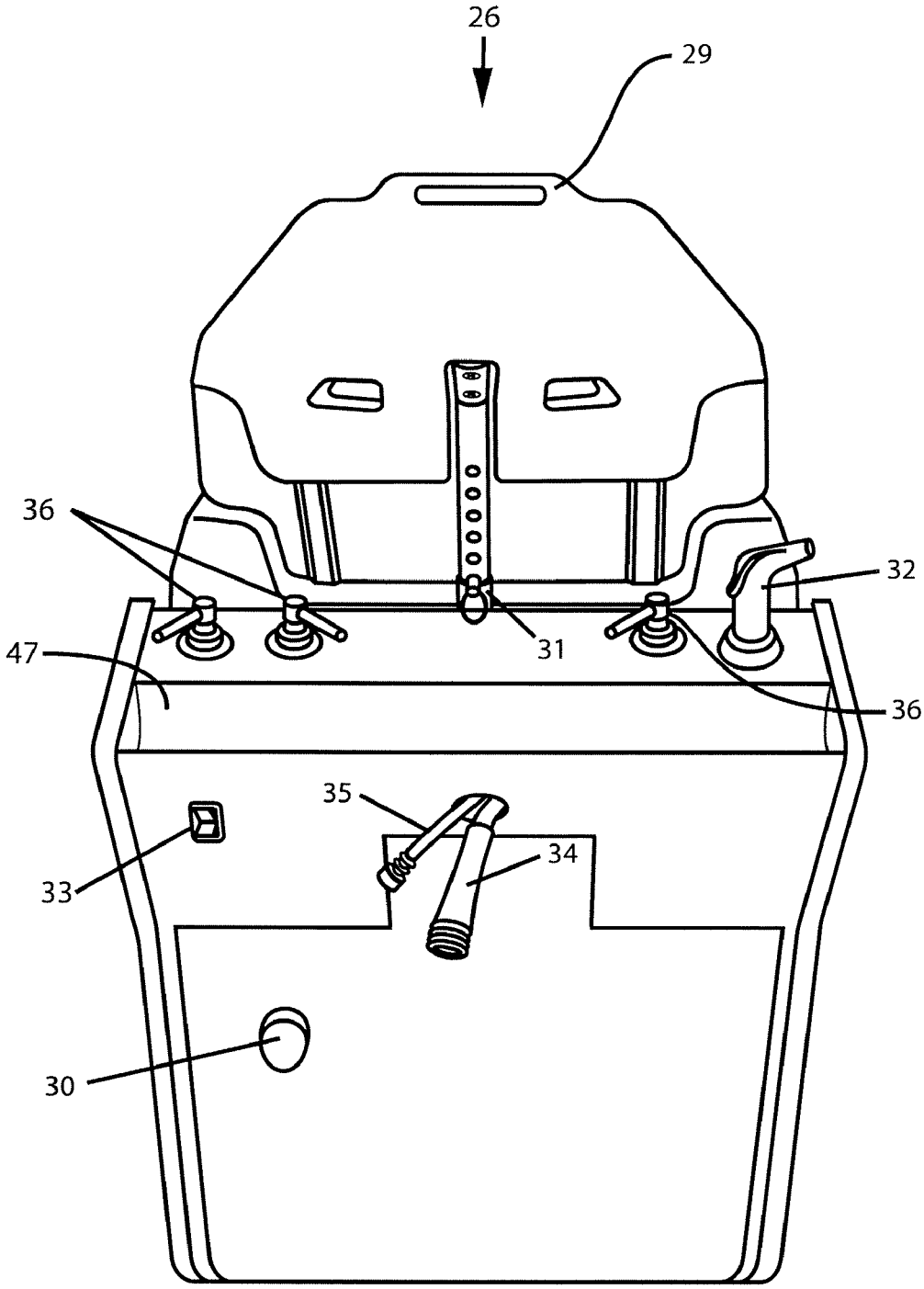
FIG. 5 illustrates a rear view of the apparatus of FIG. 1.
Figure 6:
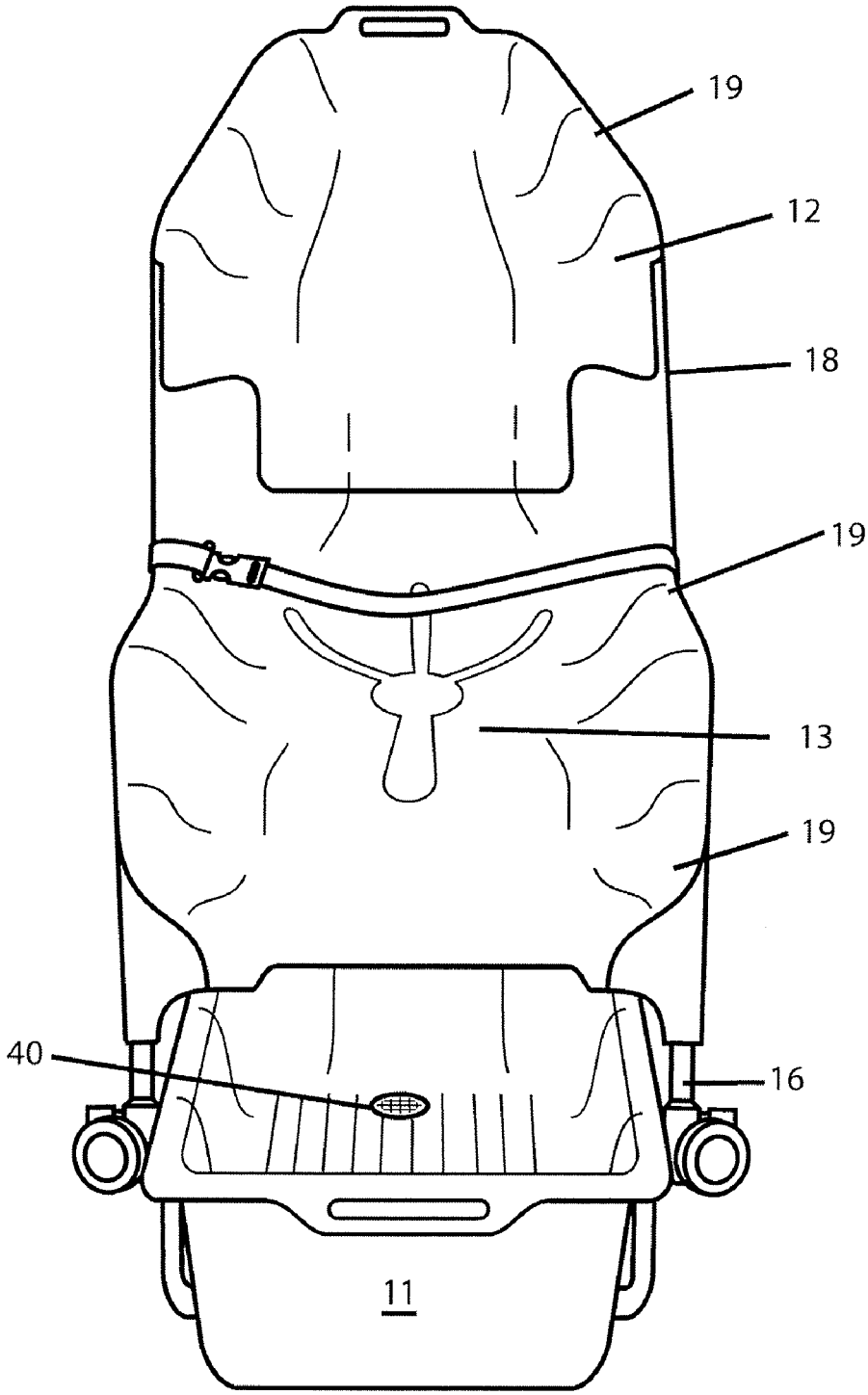
FIG. 6 illustrates a front view of the apparatus of FIG. 1.
Figure 8A:
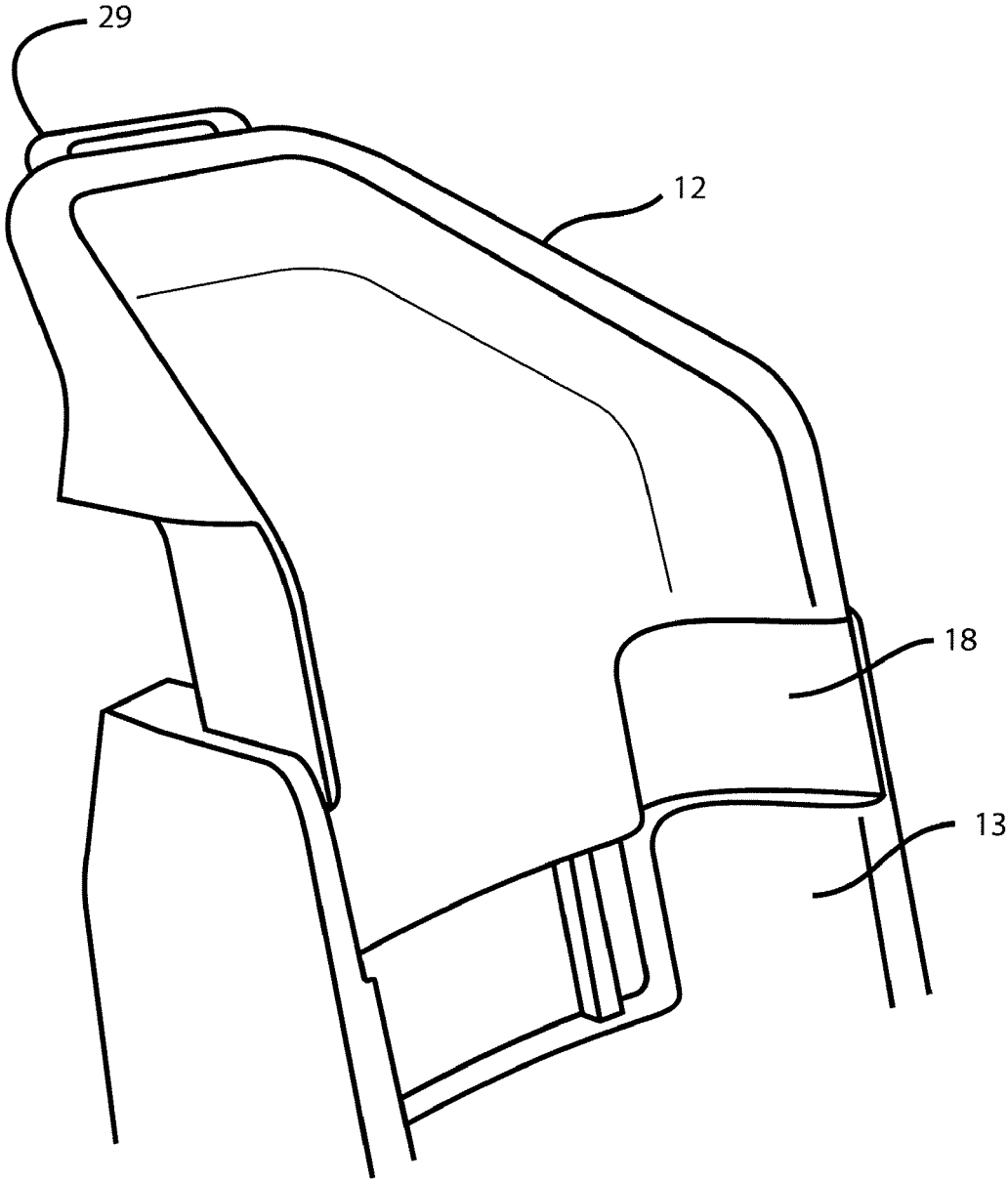
FIG. 8A illustrates a side perspective view of an upper portion of the apparatus of FIG. 1 in a raised position thereof.
Figure 8B:
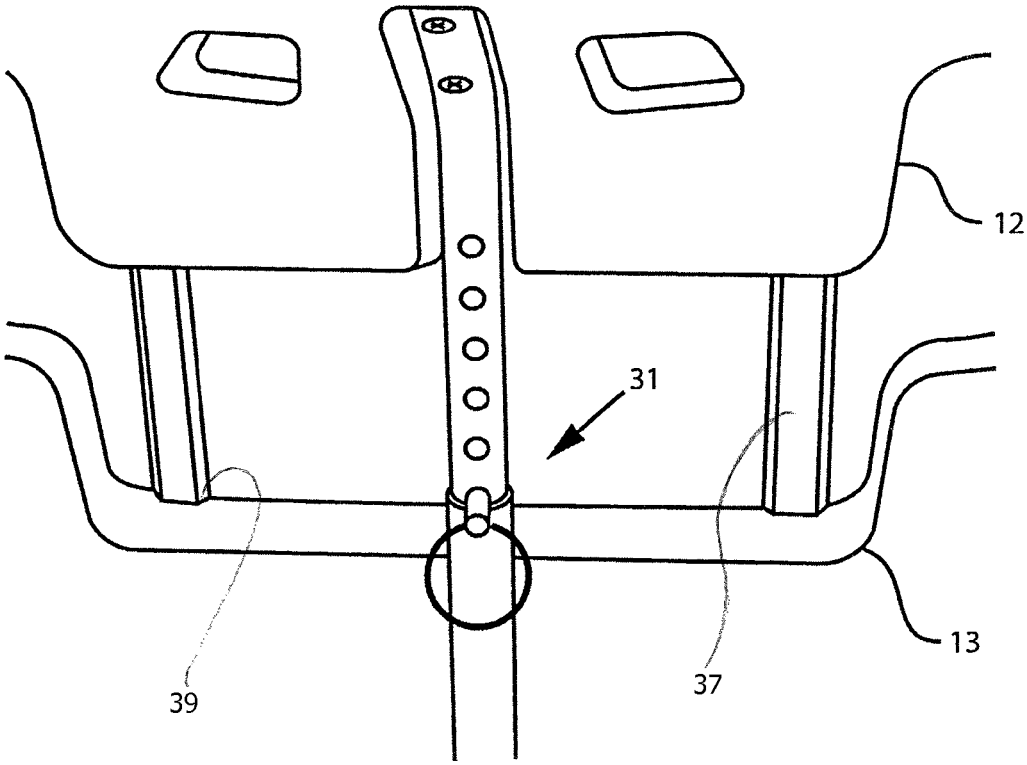
FIG. 8B illustrates a rear view of an upper portion of the apparatus of FIG. 1 in a raised position thereof.

The user support 10 includes a main lower portion 13 which supports the torso and lower body of a person/user seated on the user support, and an upper portion 12 which extends rearwardly and upwardly from the head of a user seated in the user support such that it can reliably capture water used in washing the user's hair, and is adjustably/slidably connected to the main portion in a watertight manner so that it may be adjusted to an appropriate height for the user. In this embodiment, the upper and lower portions 12, 13 are slidably connected at an overlapping adjustment portion 18, best shown in FIGS. 8A, 8B, which provides a high level of strength and rigidity, as well as a watertight fit. As shown, the upper portion 12 includes a base having a central part which extends lower than the adjacent side parts thereof. The upper portion 12 also includes a rearwardly extending projection on the rear side thereof, and a central part of the projection extends lower than the adjacent side parts thereof, while the projection is spaced upwardly from the lower edge of the base. On the other hand, the lower portion 13 has recesses or channels formed in front and upper surfaces thereof which stably, slidingly receive the various parts of the base of the upper portion 12 such that the upper portion cannot move front-to-back or side-to-side relative to the lower portion. For extra stability, projections 37 may be formed in the rear surface of the central part of the base of the upper portion 12 and mating channels 39 are formed in the front surface of the central part of the upper end of the lower portion 13 which receive the projections. Also, a locking mechanism 31 can be provided for securing the upper portion at a desired height, as best seen in FIGS. 5 and 8B. The locking mechanism may be formed as section of tubing connected to the upper portion 12 which slidably fits within another section of tubing secured to the lower portion 13, while the tubing connected to the upper portion has a series of openings formed therein spaced vertically from each other, the tubing connected to the lower portion has a single opening formed therein, and a pin which can be selectively inserted in aligned ones of the openings in the tubing sections. The upper portion 12 may have a handle 29 provided therewith, e.g., a recess formed near an upper surface thereof, which may be gripped for manipulating the upper portion, manipulating the apparatus, etc.

According to an important aspect of the present invention, the user support 10 includes a smooth, central contoured surface extending slightly rearwardly and upwardly so as to support a user in a substantially upright seating posture and a raised side surface 19 extending continuously from the support surface completely around upper and lateral side edges of the support surface such that water discharged onto a person seated on the central support surface is contained by the user support and flows downwardly to a front lower edge of the central support surface, after which it flows downwardly into the foot basin 11. Because the raised side surface 19 is not formed along the front lower edge of the central support surface, this not only permits water to easily drain into the foot basin 11, but also permits a person to stand very closely when getting into and out of the user support, and does not interfere with a user positioning his/her feet in the basin 11. As shown, the raised side surface 19 extends significantly upwardly and/or forwardly from the support surface, e.g., by 3-9 inches, so that it is effective for containing water that is sprayed or discharged onto a person seated on the user support, but it should not be extended so far that it would interfere with a caregiver's ability to bathe a patient sitting in the chair portion. Also, the raised side surface of the user support is narrow in width, e.g., 1-2 inches, such that an overall width of the user support substantially corresponds to a width of the central support surface, so that the apparatus has a relatively narrow width, e.g., 24-30 inches, so that it can be easily moved through most door openings, and will also comfortably accommodate most persons. Still further, while the side parts of the base of the upper portion 12 do not extend downwardly as far as the central part of the base, these side parts and adjacent parts of the lower portion 13 of the body support 10 continuously form the raised side surface 19 of the body support in all positions of the upper portion 12 so that no gaps are formed which would permit escape of water flowing along the body support.

The central support surface may be smooth as shown or may be textured if desired, while the raised side surface 19 may be smooth except for the central portions thereof functioning as armrests, which may be textured for improved gripping by a person when entering or exiting the apparatus, or while sitting in the apparatus. Drainage channel(s) 55 may be formed in central support surface, which are helpful for draining water from the surface, particularly at the lower rear and substantially horizontal portions thereof. The user support may be formed of molded plastic, fiber-reinforced molded plastic, or other appropriate waterproof material(s).

An adjustable seatbelt 56 may be provided in conjunction with the user support for helping to maintain a person in a desired seating posture. Some invalid patients cannot control their balance and positioning such that they cannot sit in a chair without the use of a belt or harness to help them remain upright. For example the seatbelt may be a lap belt as shown and/or a shoulder strap which secures around the person's torso. Opposite ends of the seat belt may be secured at rear portions of the user support 10 and/or to the frame 20.

Figure 4:
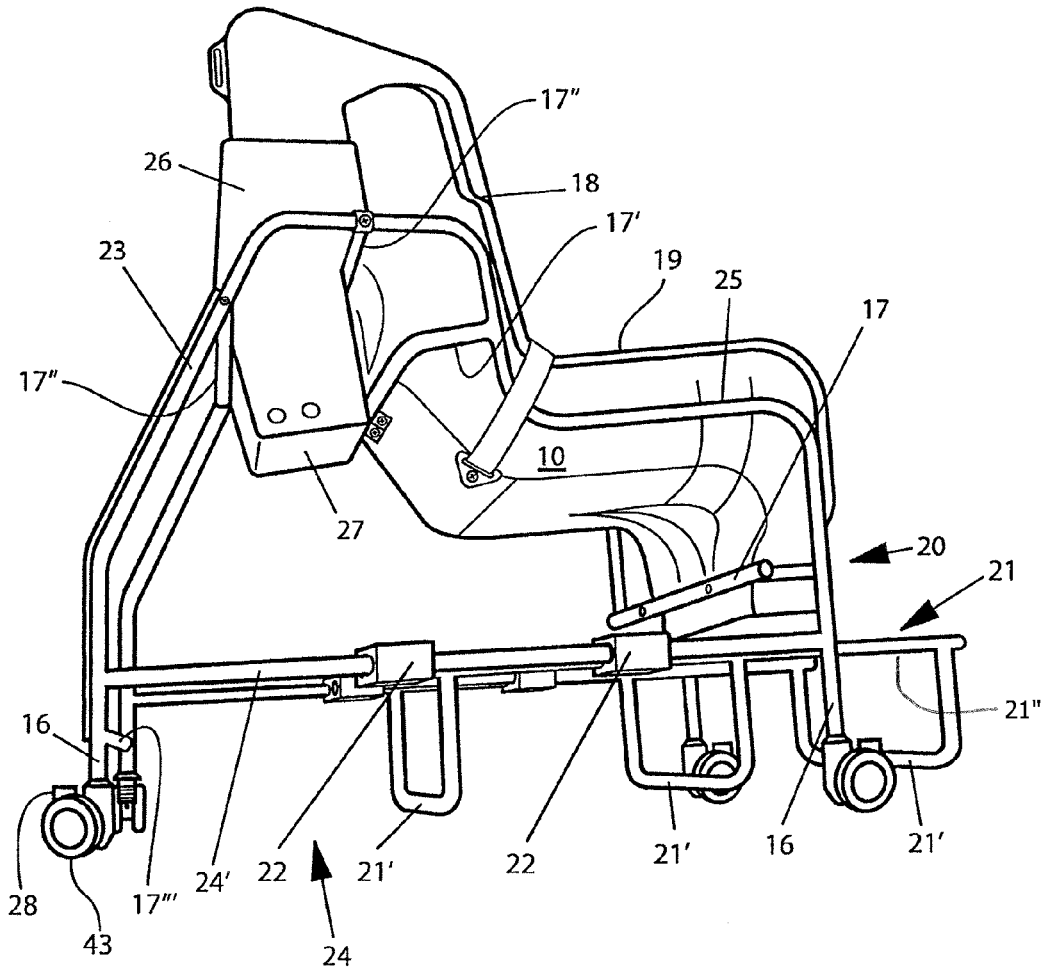
FIG. 4 illustrates a lower perspective side view of the apparatus of FIG. 1 excluding a housing and the foot basin, to thereby show details of a frame of the bathing chair.

The frame 20 can best be seen in FIG. 4 (with housing 38 removed), and includes a rear portion 23, a bottom portion 24, a front portion 25, and a tub-supporting portion 21 which is movable relative to the bottom portion 24. Again, the frame 20 may be formed lightweight material(s) such as aluminum tubing or extrusions, plastic tubing, etc. which can be easily assembled and connected to the user support 10 for achieving a very strong, rigid, lightweight structure. As shown, each of the rear portion 23, bottom portion 24, and front portion 25 may include right and left side parts which extend continuously with the corresponding side parts of the other portions, and are interconnected with transversely-extending members 17, 17' 17", 17'''. Further, the members 17, 17' may be connected to parts of the user support via screws or other appropriate fasteners for joining the frame to the user support. This lightweight arrangement provides particularly good strength and rigidity by the combination of the frame 20 and the user support 10, the frame can be easily assembled and connected to the user support, and the frame is disposed entirely within a space defined by the user support such that the frame does not add to a lateral width of the apparatus.

The bottom portion 24 may include main portions 24' which extend substantially horizontal, and support legs 16 which engage the ground. One or more of the legs 16 may be provided with wheels 43 for facilitating movement of the apparatus. Each of the wheels may include a wheel lock 28 to allow the patient attempting to use the chair easier access.

The tub-supporting portion 21 of the frame may include U-shaped legs 21' which extend downwardly, one or more of which may be connected to a bottom surface of the foot basin, e.g., in channels formed in the bottom surface, and sliding portions 21" which extend inwardly of and parallel to the main portions 24' of the bottom frame, and are slidingly connected thereto through bushings 22 or other appropriate means. The bushings 22 may be formed of an appropriate plastic such as DELRIN® and facilitate movement of the foot basin 11 between storage and operative positions. The rear frame portion 23 may support the drip tray console 26 and receptacle 27, and the receptacle may conveniently extend downwardly between the two transversely-extending members 17" as shown.

Figure 7A:
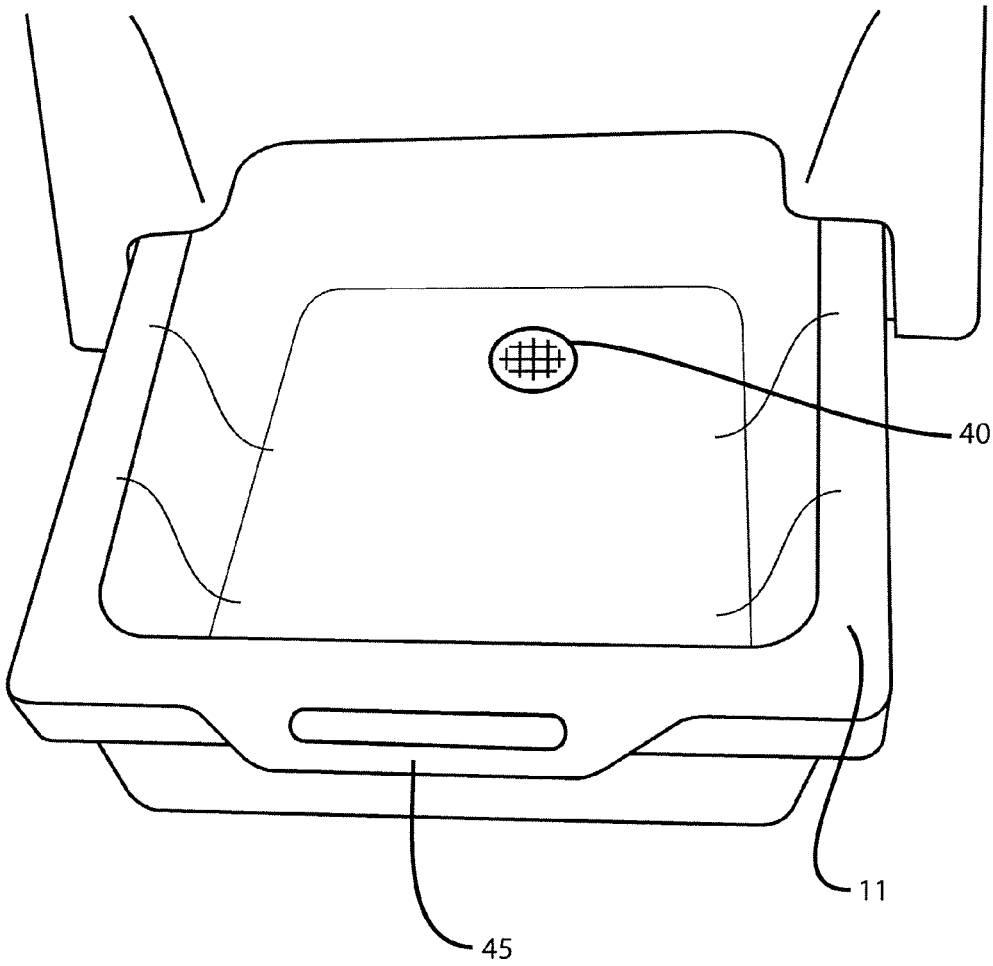
FIG. 7A illustrates a top perspective view of the foot basin of the apparatus of FIG. 1 showing some additional details of its structure.
Figure 7B:
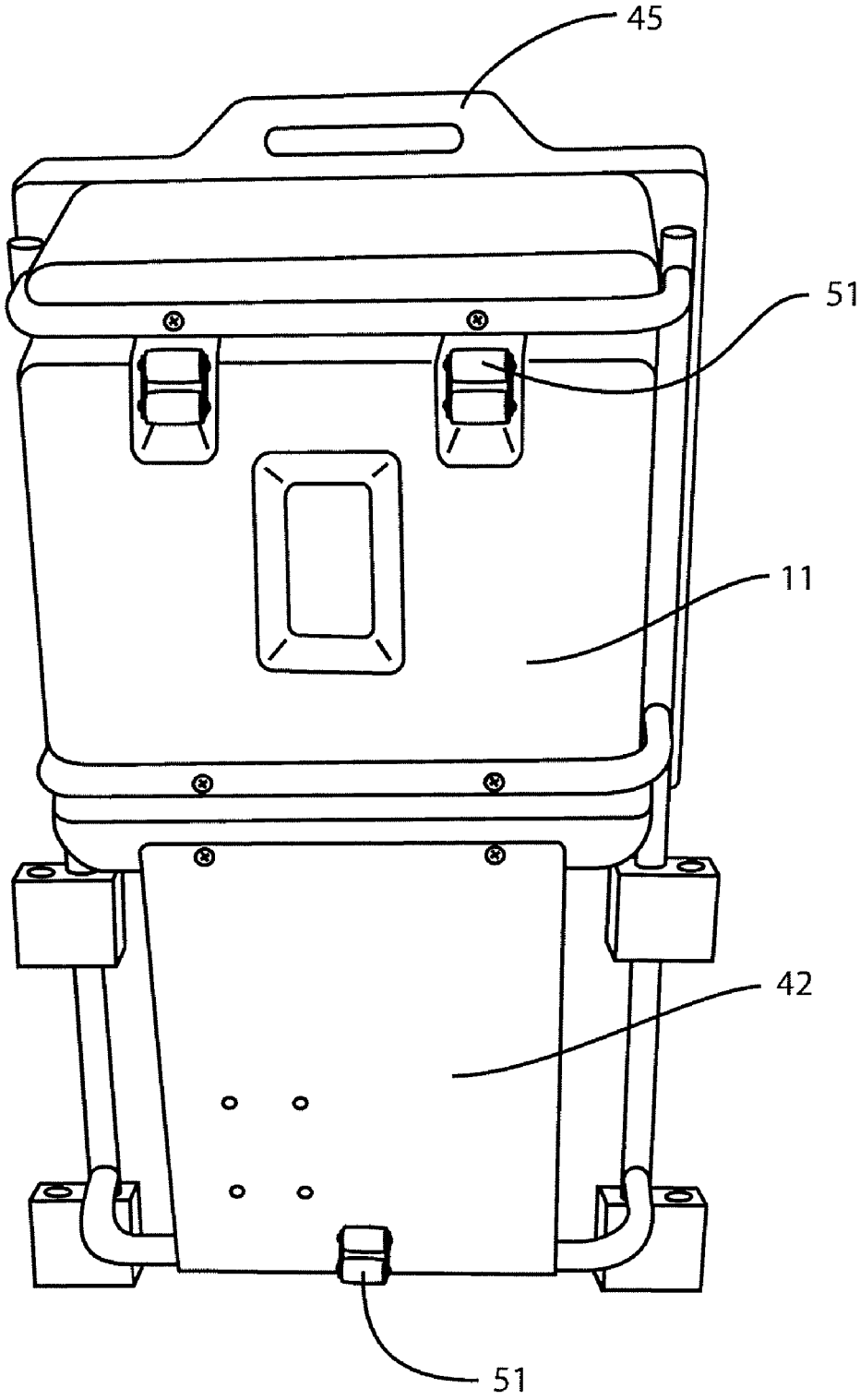
FIG. 7B illustrates a bottom plan view of the retractable foot basin and of the apparatus of FIG. 1.

The foot basin 11 may include a relatively large open-top tub formed of appropriate waterproof, lightweight material such as blow-molded plastic, and may include a slightly sloped/inclined bottom surface and a drain 40 permitting water that collects in the tub to be readily discharged from the drain via the pump 41 and the hosing 35. The drain 40 can be readily formed as a recessed drain near the rear edge of the bottom surface, channels for receiving the U-shaped legs 21' can be easily formed in the lower surface of the basin, texturing can be formed on the bottom foot-engaging surfaces of the basin, and an integral handle 45 can be formed with the basin at the time it is manufactured via blow-molding or otherwise. As shown in FIG. 1, a rear wall of the basin may remain beneath the user support rearwardly of the central front edge of the user support in the operative position of the basin so that all of the water flowing off of the user support will surely drain into the basin. For this purpose, the tub-supporting portion 21 of the frame and/or the basin 11 may include a stopper or the like to limit the forward movement of the basin. As shown in FIG. 7B, the basin may also include rollers 51 or other appropriate means to facilitate movement of the basin between its storage and operative positions. A strainer cover may be provided over the recessed drain 40, to prevent objects from being sucked into the drain. If it is desired to soak a person's feet in the basin 11, then the pump 41 would not be actuated to permit water to collect in the tub, although a plug or other cover may be selectively fitted into/over the drain as well. The basin 11 may be used as a storage area for accessories such as the hand basin 14 best seen in FIG. 1, towels, etc. The accessories may be placed in the foot basin 11 for transportation to the patient and removed for the bath.

As shown in FIGS. 1-3, 7A and 7B, the pump 41 may be provided on a support tray 42 disposed rearwardly of the basin 11 and which is also supported by the tub-supporting portion 21 of the frame such that the pump and moves together with the basin between its storage and operative positions. The tray 42 may also have rollers 51 or other appropriate means on its lower face to facilitate movement between its storage and operative positions. An inlet of the pump 41 may be connected to the drain 40 with a section of tubing, an outlet of the pump may be connected to the water discharge hosing 35, and the pump may be powered by the power supply 30. Again, the power supply may be a rechargeable battery, which is desirable because it is low voltage to minimize any risk of electrical shock, and is very convenient to use in any location.

The drip tray console 26 is designed to conveniently provide all the needed connections, power supply, adjustments and accessories in one location for ease of use by the caregiver. The water discharge nozzle 32 may be in the form of a spray head provided on an extendable hose to allow the caregiver the ability to direct the water to desired locations on a person sitting on the apparatus 1. Soap, shampoo, lotion or other bath needs may be provided in any number of dispensers 36 in the console 26, while a drip tray 47 formed integrally with the console 26 is located rearwardly and downwardly of the dispensers where it can conveniently catch any drips dropping from the dispenser nozzles, the spray nozzle, etc. The console 26 may also include the power supply 30 such as a rechargeable battery that can be removed from the apparatus for recharging, for example, and a power on/off switch 33 may be provided to selectively actuate the pump. The water supply hosing 34 may be sufficiently long to reach a sink from any position within a bedroom, laundry room, kitchen, etc., and may include a threaded female coupling or other appropriate coupling which can be attached to any conventional faucet to provide clean water that can be discharged through the nozzle 32. This is particularly convenient because the temperature of the water may be adjusted as desired using the existing faucet controls, and without any special or additional temperature control component(s) on the apparatus 1. The water discharge hosing 35 may also be sufficiently long to reach a sink, toilet or other drain from any position within a bedroom, for example. The hosing 34, 35 may be equal in length and may be coupled together for convenience in extending and retracting the same. The console 26 is designed to conceal the frame and other internal structure of the apparatus 1, and may include graphic or text instructions for operation of the apparatus. The hosing 34, 35 may be stored inwardly of the console and may be retained in the receptacle 27, for example. The hosing may simply inserted into or retracted from the receptacle via manual force, although some type of retraction mechanism may be provided to facilitate such actions.

The locking device 31 associated with upper portion 13 of the user support 10 may be provided above the drip tray console 26, for permitting easy access to the locking device 31 when adjusting the size (height) of the user support.

The housing 38 may include panels provided on the lateral sides of the frame 20 to provide an aesthetic finished look to the apparatus 1, concealing the frame 20 and other components disposed within the frame 20 and user support 10. A housing panel may also be provided at the rear of the apparatus. As shown, the lateral side panels of the housing extend substantially vertically downward from the outside edges of the raised side surface 19 of the user support such that the housing does not add to the lateral width of the apparatus. This is advantageous for moving the apparatus through narrow openings.

The hand basin 14 is an accessory for providing a soaking area for hands such that a manicure or the like can be conducted on the bather. As shown, the hand basin may include a watertight receptacle 14', and a support frame 14" fixed to the receptacle and including a lower projection. The transversely-extending frame member 17 may have opposite ends which are open and sized to selectively receive and retain therein the lower projection of the support frame 20". As shown, openings 38' may be formed in the lateral side panels of the housing 38 at positions which correspond to the open ends of the member 17, for permitting insertion of the lower projection of the support frame 20" therethrough. As shown, the section of the frame 20 which supports the hand basin 14 may also interconnect the opposite sides of the frame and be secured to the user support.

With the apparatus 1 according to the present invention, persons with limited mobility can enjoy a high-quality, refreshing, bathing experience without having to move any significant distance from their beds or in any other convenient location such as a half bath, kitchen, laundry room, etc. The apparatus can be readily moved directly adjacent to most beds because of its narrow, portable construction. After the individual is moved onto the user support and secured with the seat belt, the upper portion 12 of the user support adjusted to a proper height, the hosing 34, 35 is appropriately located and connected to a water source, and the basin 11 moved to its operative position, a caregiver can bathe the individual using the discharge nozzle to discharge a steady stream/spray of water onto the individual, etc. The discharged water is continuously drained downwardly along the user support into the basin 11 where it can be steadily discharged from the basin by actuating the pump. In this way the individual is continuously rinsed with clean water at a desired temperature, and can feel as refreshed as if he/she took a conventional bath or shower.

Although a selected illustrative embodiment of the present invention has been described with specificity herein, the foregoing description is intended to be an illustration, and not a restriction in the scope of the invention. Those skilled in the art will realize that many modifications of the embodiment could be made which would be operable.

For example, while the apparatus 1 is discloses as a narrow unit which can accommodate most persons, there is a practical limit to the size of person which may comfortably sit in such narrow apparatus. Thus, applicant also proposes larger versions of the apparatus for accommodating larger sized persons. Such larger sized versions may have essentially the same structure as the apparatus 1 but in a larger width, or may have a collapsible construction which permits the apparatus to be collapsed for being moved through a narrow space and then assembled into an operative form as desired. According to one such larger embodiment, the lower portion 13 of the user support 10, together with the foot basin 11 and a front section of the frame 20, can be provided as a first separately movable unit which can easily fit through most door openings, and similarly the upper portion 12 of the user support, together with the drip tray console 26 and receptacle 27, and a rear section of the frame, may be formed as a second separately movable unit which can easily fit through most door openings, and the front and rear sections of the frame may be provided with couplings which permit them to be easily connected and disconnected relative to each other. When it is desired to move the apparatus through a narrow space, for example, the first and second separately movable units are disconnected, moved through the narrow space, and then re-connected together. For convenience, each of the front and rear sections of the frame may include two or more wheels for facilitating movement thereof, while the hosing extending from the pump at the first unit to the exterior of the apparatus at the second unit may include quick disconnects.

As another example, while the hosing 34, 35, discharge nozzle 32, and pump 41 are disclosed as being provided with the apparatus 1, these components could be eliminated or replaced with other components. For example, the hosing 34, 35 and discharge nozzle 32 could be replaced by single, stand-alone length of hosing having a coupling to be attached to a water supply faucet at one end and the discharge nozzle at the other end, and which is simply stored in the basin 11 when not used, rather than being attached to and disposed with/within the drip tray console 26 or the receptacle 27. As another example, the basin need not have a drain associated therewith. Instead once the basin has collected a sufficient amount of water it could be moved to a sink or toilet and dumped out, or a pail could be used empty used water from the basin.

As still another modification, the apparatus could be provided with its own water supply storage receptacle, etc., such that it would be fully self-contained. Typically, it takes approximately five gallons of water to bathe the average person using the portable personal hygiene apparatus according to the invention, so that tank(s) of approximately this size could be used.

I claim:

1. A portable personal hygiene apparatus, comprising:

a water-impermeable user support shaped to support a person in a seated posture and with the person's feet on a support surface in front of the apparatus, including a support surface contoured to receive a person's body thereon and a raised side surface extending continuously from the support surface completely around upper and lateral side edges of the support surface such that water discharged onto a person seated on the support surface is contained by the user support and flows downwardly to a front lower edge of the support surface;

a support frame fixed to the user support and having at least one wheel permitting rolling movement of the apparatus; and a basin selectively positionable in a retracted position beneath the user support and an operative position extending forwardly of and below the lower front edge of the support surface such that any water flowing off of the support surface drains into the basin;

wherein the user support has a fixed position on the support frame;

wherein the support surface of the user support includes an upper section which is configured to be engaged by the person's back and head, a seat section extending forwardly from the back section, and a front section which extends substantially vertically downward from a front edge of the seat section; and wherein the raised side surface of the user support is narrow in width such that an overall width of the user support substantially corresponds to a width of the support surface.

2. A portable personal hygiene apparatus according to claim 1, wherein the support frame includes a portion which supports the basin and which is connected to another portion of the support frame such that the basin can be moved between the positions thereof.

3. A portable personal hygiene apparatus according to claim 2, where in the basin has a drain formed in a bottom surface thereof and the apparatus further comprises a pump for facilitating discharge of the used water from the basin.

4. A portable personal hygiene apparatus according to claim 1, further comprising hosing secured to at least one of the user support, the support frame, and the basin, and which is configured to be selectively connected to a water supply and used to discharge water from the water supply onto a person seated on the user support.

5. A portable personal hygiene apparatus according to claim 4, further comprising additional hosing configured to discharge water from the basin.

6. A portable personal hygiene apparatus according to claim 4, further comprising a storage receptacle disposed within the frame which stores the hosing.

7. A portable personal hygiene apparatus according to claim 1, wherein the user support includes a lower portion which receives a person's torso and lower body, and an upper portion which is connected to the lower portion by a mechanism which permits the upper portion to be disposed in different positions relative to the lower portion, and wherein each of the lower and upper portions include parts of the support surface and the raised side surface.

8. A portable personal hygiene apparatus according to claim 7, wherein said upper portion of the user support includes a base which is connected to the lower portion of the user support such that the upper portion can be disposed in the different positions thereof relative to the lower portion while maintaining the raised side surface completely around upper and lateral side edges of the support surface.

9. A portable personal hygiene apparatus according to claim 7, further comprising a locking mechanism for securing the upper portion of the body support in the different positions thereof.

10. A portable personal hygiene apparatus according to claim 1, further comprising a housing which surrounds lateral and rear sides of the user support and the frame.

11. A portable personal hygiene apparatus according to claim 10, wherein lateral side portions of the housing extend substantially vertically downward from outside edges of the user support such that the housing does not add to a lateral width of the apparatus.

12. A portable personal hygiene apparatus according to claim 1, further comprising a receptacle which may be selectively connected to the frame at lateral sides of the apparatus and which is adapted to receive a hand of a person seated on the user support.

13. A portable personal hygiene apparatus according to claim 1, wherein the seat section of the support surface of the user support has a drain channel formed therein which extends to the front edge of the seat section.

14. A portable personal hygiene apparatus according to claim 1, further comprising a control console at a rear portion of the frame for being manipulated by a caregiver assisting a person reclined on the user support.

15. A portable personal hygiene apparatus according to claim 1, wherein a lower surface of the basin engages the support surface in front of the apparatus and the basin is configured to receive the person's feet therein when the basin is in its operative position.

16. A portable personal hygiene apparatus according to claim 1, wherein the basin is also connected to the support frame.

* * * * *